US006289643B1

(12) United States Patent
Bonar

(10) Patent No.: US 6,289,643 B1
(45) Date of Patent: Sep. 18, 2001

(54) RESIDENTIAL MOTORIZED SLIDING DOOR ASSEMBLY

(75) Inventor: Christopher L. Bonar, Kent, WA (US)

(73) Assignee: Autoglide, Inc., Kent, WA (US)

( * ) Notice: Subject to any disclaimer, the term of this patent is extended or adjusted under 35 U.S.C. 154(b) by 0 days.

(21) Appl. No.: 09/390,940

(22) Filed: Sep. 7, 1999

(51) Int. Cl.[7] ..... E06B 1/04
(52) U.S. Cl. ..... 52/207; 49/505
(58) Field of Search ..... 49/505, 409, 410; 52/207, 210, 217

(56) References Cited

U.S. PATENT DOCUMENTS

| | | | | |
|---|---|---|---|---|
| Re. 34,053 | * | 9/1992 | Kennedy et al. | 405/132 |
| 1,741,940 | * | 12/1929 | Jacobson | 49/505 |
| 3,261,129 | | 7/1966 | Brydolf et al. . | |
| 3,400,490 | * | 9/1968 | Anderson | 49/505 |
| 3,971,601 | | 7/1976 | Systma | 308/16 |
| 4,050,189 | * | 9/1977 | Peterson | 49/26 |
| 4,325,204 | * | 4/1982 | Martine | 49/372 |
| 4,404,770 | | 9/1983 | Markus | 49/235 |
| 4,517,767 | * | 5/1985 | Dewson | 9/464 |
| 4,897,889 | * | 2/1990 | Baus | 4/607 |
| 5,134,324 | | 7/1992 | Sakagami et al. | 49/360 |
| 5,172,518 | | 12/1992 | Yoshino | 49/360 |
| 5,222,838 | * | 6/1993 | Kennedy et al. | 405/302 |
| 5,240,349 | * | 8/1993 | Kennedy et al. | 405/132 |
| 5,293,962 | | 3/1994 | Pelvilain | 187/1 |
| 5,373,120 | | 12/1994 | Barrett et al. | 187/316 |
| 5,495,918 | | 3/1996 | Peruggi et al. | 187/316 |
| 5,584,142 | * | 12/1996 | Spiess | 49/411 |
| 5,605,016 | * | 2/1997 | Pollard | 49/506 |
| 5,808,381 | * | 9/1998 | Aoyama et al. | 310/12 |
| 6,058,655 | * | 5/2000 | Gravel | 49/372 |

* cited by examiner

*Primary Examiner*—Daniel P. Stodola
*Assistant Examiner*—Curtis A. Cohen
(74) *Attorney, Agent, or Firm*—Dean A. Craine

(57) ABSTRACT

A motorized sliding door assembly including a sliding door that slides longitudinally inside an outer support frame assembled in a standard 2×4 stud wall opening in a building. The support frame includes a load-bearing header located horizontally between two vertical posts and opposite a lower threshold. Jack screws are placed between the ends of the header and the vertical posts which enable the position of the header to be adjusted relative to the vertical posts and against the ceiling plate. Located inside the header is a longitudinally aligned track rail that rests on top of the vertical posts over which the sliding door moves. Located inside the header is a linear motor. Disposed vertically inside the support frame are two parallel fixed panels that are sufficiently spaced-apart to create a pocket in which the sliding door may extend. Also provided around the support frame and fixed panels is a sealing frame assembly that creates a weather-tight seal therebetween when the sliding door is closed.

20 Claims, 7 Drawing Sheets

(part 28 removed for clairity)

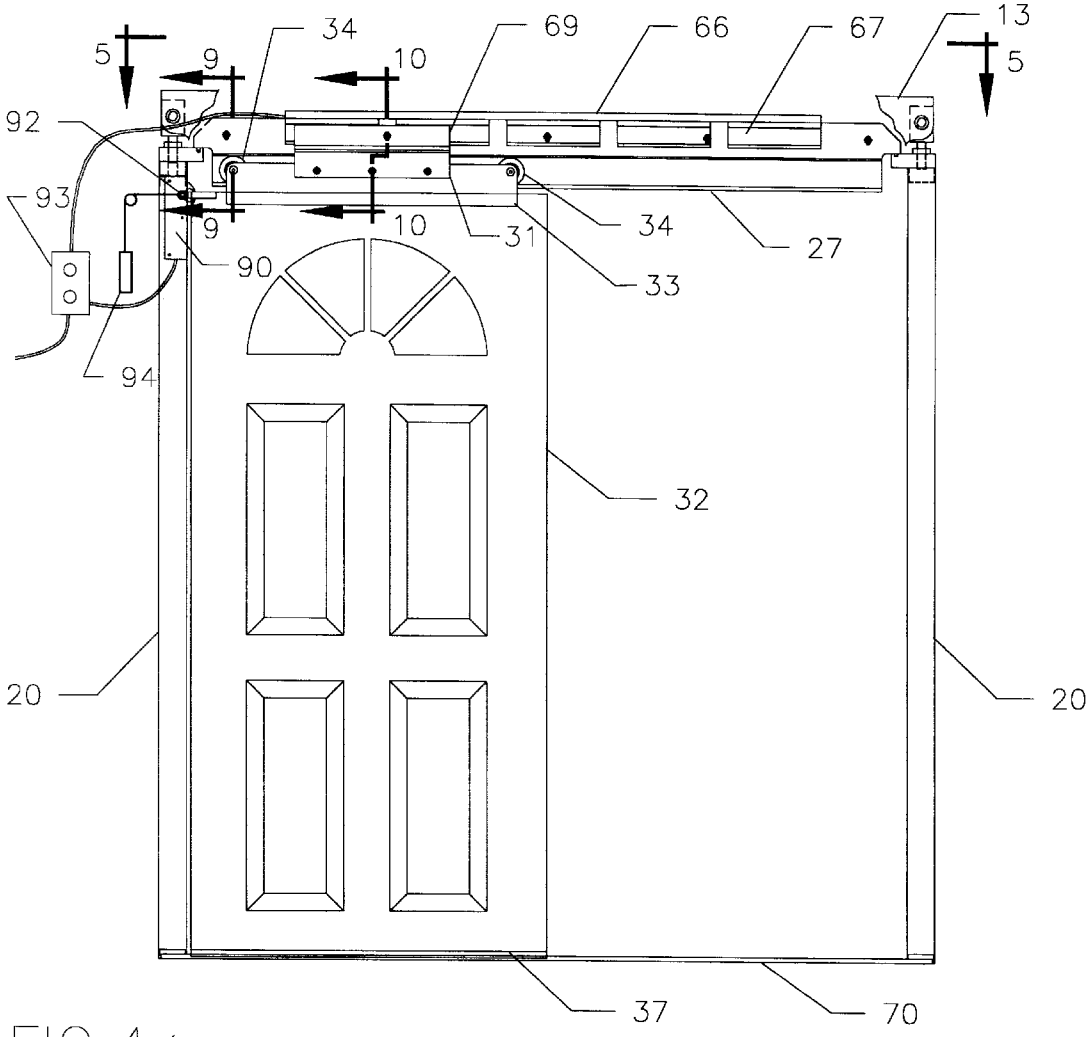
FIG. 4 (part 28 removed for clairity)
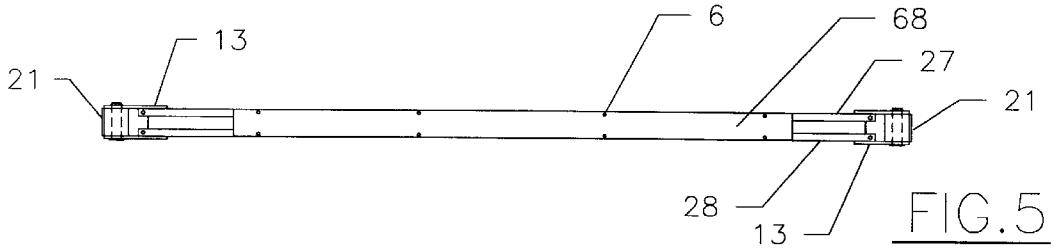
FIG. 5

RESIDENTIAL MOTORIZED SLIDING DOOR ASSEMBLY

BACKGROUND OF THE INVENTION

1. Field of the Invention

The present invention relates to sliding door assemblies and, more particularly, to motorized sliding door assemblies designed for residences.

2. Description of the Related Art

It is widely known that, in residences, standard ceiling heights range between 90 and 96 inches and standard door heights range between 80 and 82 inches. The distance between the top of the door and the ceiling, hereinafter called the header space, ranges between 10 and 16 inches. When constructing doorways on exterior or interior support walls, a single thick piece of wood is used as a single header, or two thin pieces of wood placed side-by-side are used as a double header to support the ceiling load. As a result, any empty space above the door for other structures or other objects is small or non-existent.

Many mechanical doors for residences, such as garage doors, are rated according to the number of times they are opened. For example, inexpensive garage doors are rated for 10,000 to 20,000 openings, while more expensive garage doors are rated for 30,000 to 50,000 openings. The different ratings are usually attributed to the design of the door and the quality of materials.

In many residences, pocket doors are commonly constructed in non-supporting, interior walls where wall and room space is limited or when a hinged door is architecturally undesirable. Typically, pocket doors are lightweight and include two or more guide wheels attached to the top edge of the door that travel along a horizontally aligned rail attached to the inside surface of a header jam on a pocket door frame. Additional guide wheels or clips may be attached to the bottom edge of the door to keep it vertically aligned inside the pocket door frame. The pocket door is opened by manually pushing it into a "pocket", built into the wall located adjacent to the opening.

Pocket doors described above have not been used as entrance doors in residences for many reasons. First, they are not sufficiently durable for the numerous openings entrance doors typically must endure. Second, the limited space above the header required for doors and their reduced security and weatherproofing characteristics make them undesirable. Third, many residence owners find manually opening and closing a sliding door more inconvenient or difficult than opening and closing a hinged door.

SUMMARY OF THE INVENTION

It is an object of the present invention to provide a sliding door assembly to be used as an interior or exterior door in a residence.

It is another object of the present invention to provide such a sliding door assembly that is motorized and capable of being used on standard, 2×4 wood stud frame walls.

It is a further object to provide such a sliding door assembly that includes adequate security and weather-resistant features required for an exterior door.

These and other objects of the present invention are met by a motorized sliding door assembly for a residence comprising a sliding door disposed in a support frame constructed in a standard opening in a standard exterior or interior 2×4 stud frame wall. The support frame includes a full extending, load bearing header, two vertical, equal-length side posts, and a threshold. During installation, the header is supported on its opposite ends by a header adjustment means located on the upper end of each side post that enable the header to be positioned against the ceiling top plate to support the ceiling load.

When the header is positioned against the ceiling top plate, the ceiling load is transferred to the side posts and then to the threshold. Disposed longitudinally inside the header is a track rail that is directly supported by the upper end of each side post thereby disposing the track rail parallel to the threshold. During assembly, the sliding door includes a set of wheels attached to brackets that enable the sliding door to move longitudinally along the track rail.

Also located inside the header is a low profile motor coupled to the sliding door that selectively moves the sliding door longitudinally along the track rail. In the preferred embodiment, the motor is a brush-less, linear motor with no moving parts to reduce sound and lower service requirements. The motor is electrically connected to an electricity source and a switch means that allows the user to selectively open and close the sliding door.

The threshold is approximately the same length of the header and extends horizontally below the two side posts. It is used to attach the side posts to the sub-floor and to transfer the ceiling load and the weight of the header and sliding door to the sub-floor. Disposed between the threshold and the lower end of the sliding door is a guide means that keeps the sliding door in alignment over the threshold during operation.

Disposed vertically over approximately one-half the opening located inside the support frame are two fixed panels. The fixed panels are longitudinally aligned in a fixed, parallel position inside the open space created inside the support frame. The fixed panels are spaced-apart thereby creating a pocket in which the sliding door may enter when the sliding door is opened.

Located around the inside and outside surfaces of the support frame and the fixed panels is a sealing frame assembly that beautifies the assembly and creates a secure, weather-resistant barrier when the sliding door is closed. An optional locking means is also provided between the sliding door and the frame assembly for additional security.

DESCRIPTION OF THE DRAWINGS

FIG. 4 is a rear elevation view of the sliding door assembly with the fixed panels, the sealing frame assembly, and the support rail being removed showing the placement of the track rail between the two side posts, the sliding door attached to the track rail, and the linear motor located inside the header.

FIG. 5 is a top plan view of the support frame as shown along Line 5—5 in FIG. 4.

DESCRIPTION OF THE PREFERRED EMBODIMENT(S)

Figure 1:
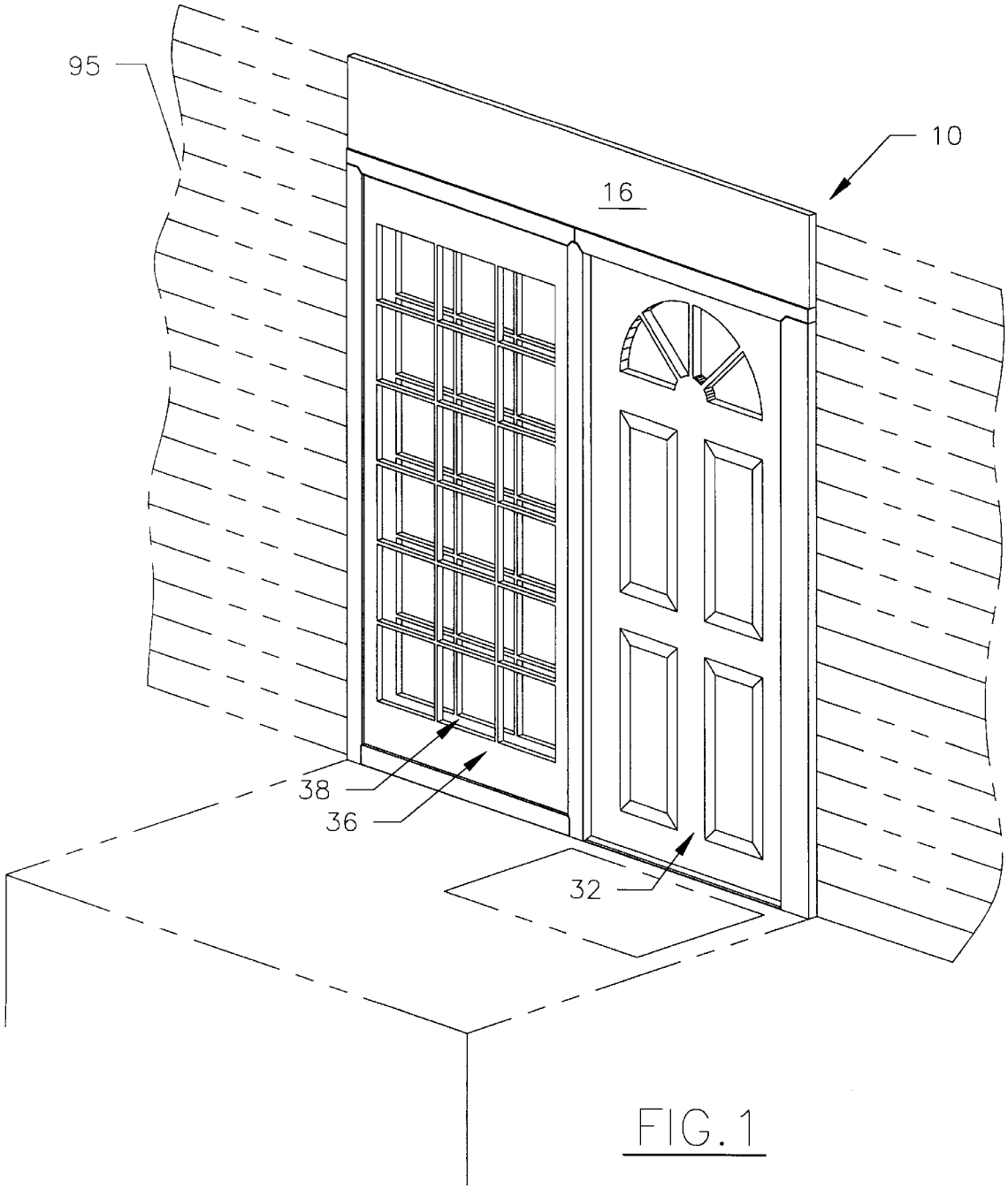
FIG. 1 is a perspective view of the motorized sliding door assembly disclosed herein shown as a main entrance to a residence.
Figure 2:
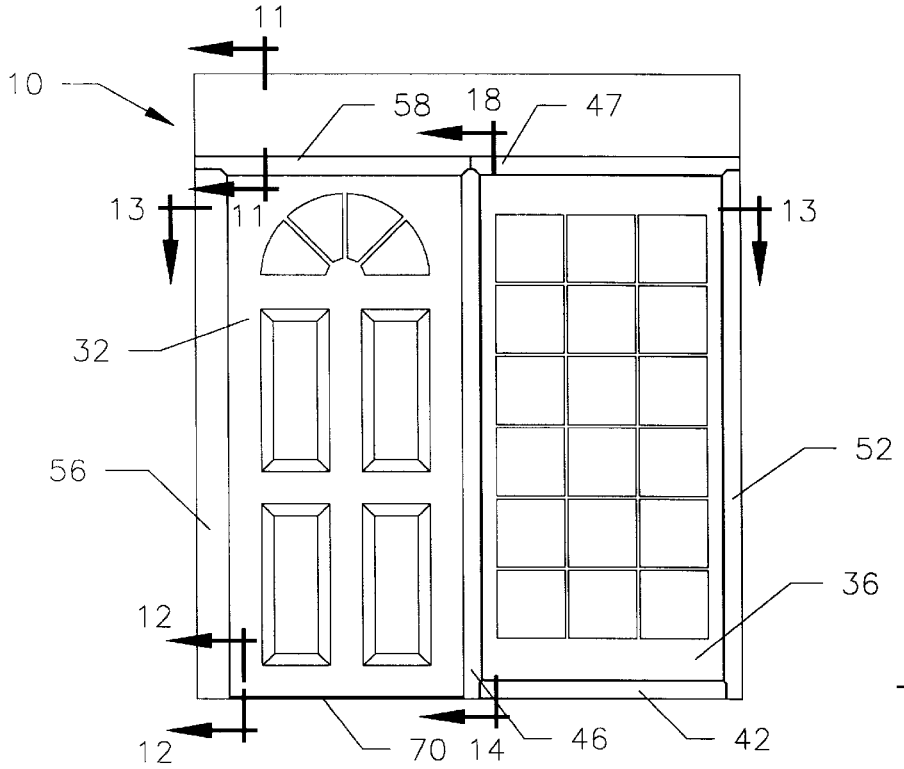
FIG. 2 is a rear elevation view of the motorized sliding door assembly shown in FIG. 1.
Figure 3:
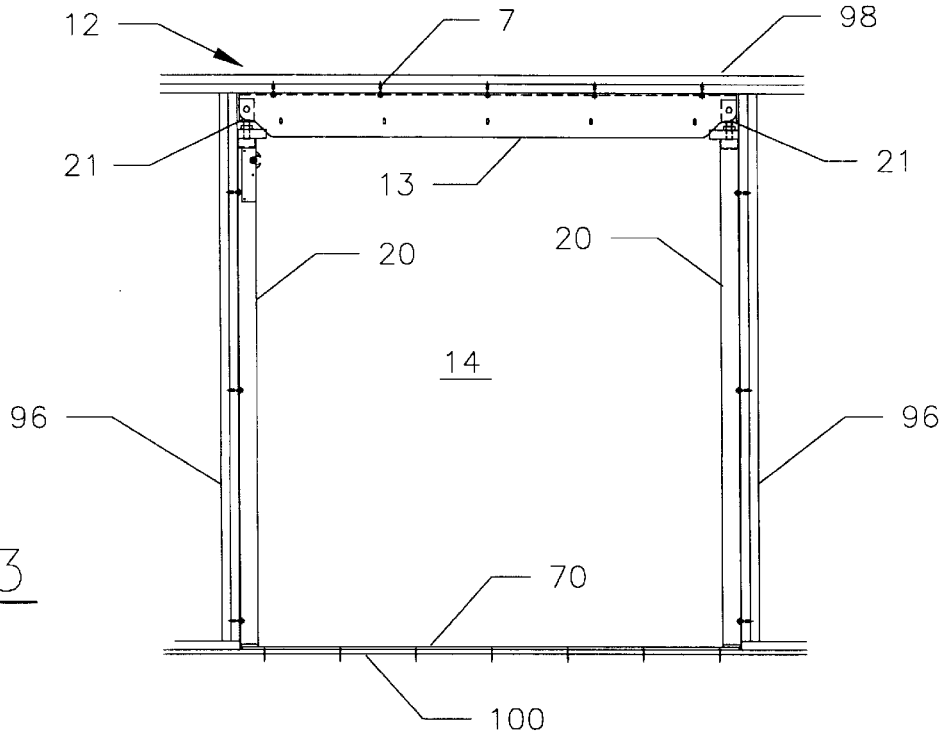
FIG. 3 is a front elevation view of the support frame installed in a rough opening created in a standard 2×4 stud frame wall.

Referring to FIGS. 1–3, there is shown a motorized sliding door assembly 10 that includes ceiling load supporting, security, and weather-resistant features that enable it to be used in an exterior or interior wall of a building. The assembly 10 also is designed specifically for a 2×4 stud frame wall 96 on a building 95 thereby enabling it to be used in new construction or retro-fitted into an existing building. The assembly 10 includes a sliding door 32 which slides horizontally inside a strong, durable support frame 12. Located on one side of the support frame are two fixed panels 36, 38, that are spaced-apart to create a pocket in which the sliding door 32 extends when opening.

As shown in FIG. 3, the support frame 12 is assembled inside an opening 97 formed in the wall 96. The support frame 12 includes a load bearing header 13 supported at its opposite ends by two vertically aligned side posts 20. The lower end of each side post 20 is securely attached to the opposite ends of a threshold 70 attached to the sub-floor 100. The opposite ends of the header 13 are pivotally attached to a height adjustable corner assembly 21 connected to the upper end of each side post 20 as shown more clearly in FIGS. 6 and 7. Each corner assembly 21 includes a load bearing member, such as an adjustable jack screw 23, disposed between the upper end of the side post 20 and the end of the header 13. During assembly, the jack screw 23 is inserted into the end of the side post 20 so that the upper section of the jack screw extends into the central space 15 of the header 13. A transversely aligned clevis pin 22 extends through the header 13 and the upper section of the jack screw 23 to pivotally interconnect the end of the header 13 to the upper section of the jack screw 23. During use, the jack screws 23 may be independently adjusted in height so that the entire header 13 is forced upward against the ceiling top plate 98 on the ceiling located over the opening 97. This independently adjustable feature of the jack screws 23 enables the user to adjust the position of the header 13 so that it fully supports the ceiling load even when the ceiling top plate 98 is not horizontally aligned with the sub-floor 100.

Figure 6:
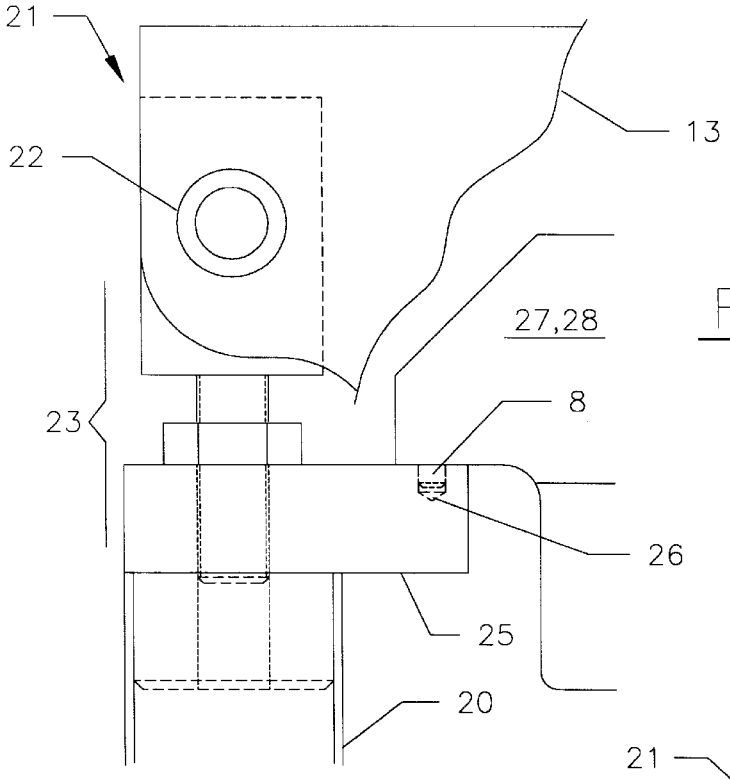
FIG. 6 is a partial, front elevation view of the corner assembly used to attach the header and track rail to the upper end of a side post.
Figure 7:
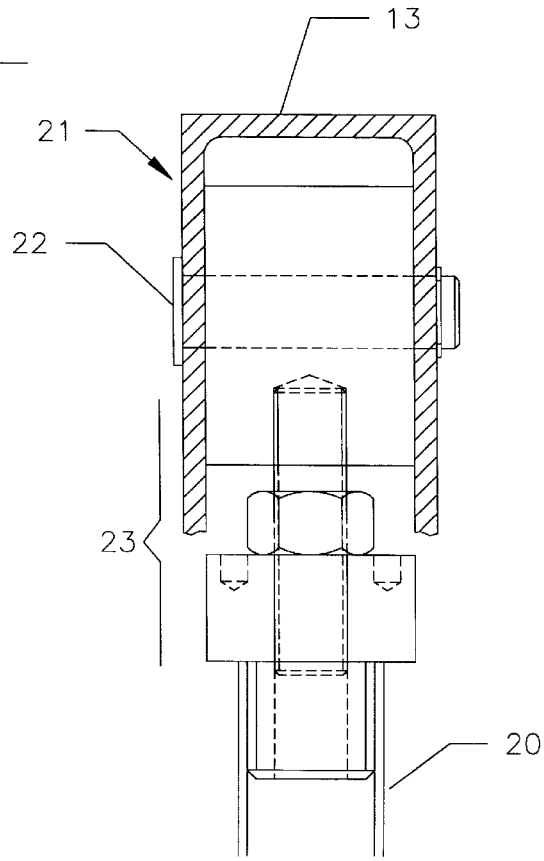
FIG. 7 is a sectional side elevation view of the corner assembly shown in FIG. 6.
Figure 9:
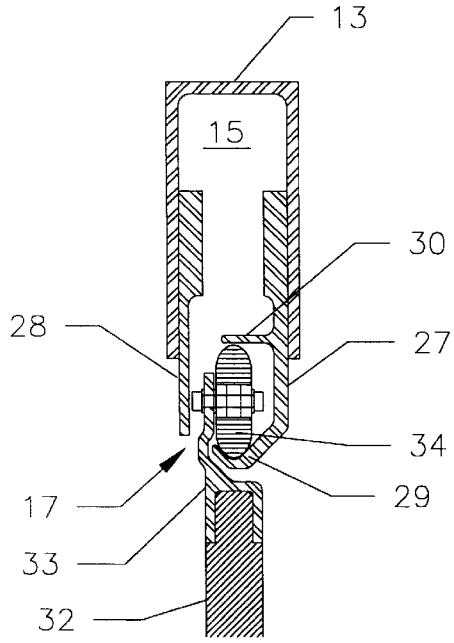
FIG. 9 is a sectional side elevation view taken along Line 9—9 in FIG. 4.
Figure 10:
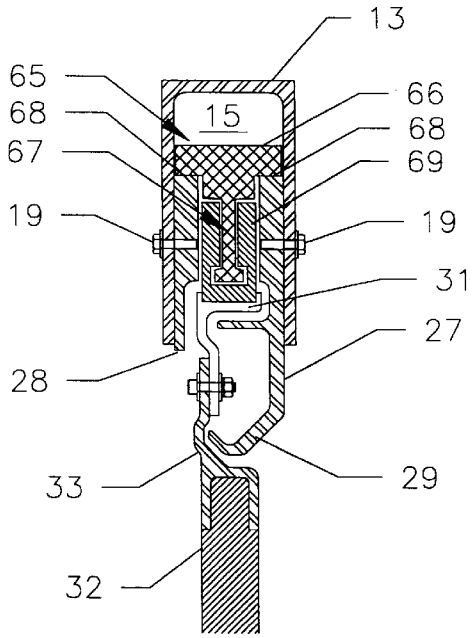
FIG. 10 is a sectional side elevation view taken along Line 10—10 in FIG. 4.
Figure 11:
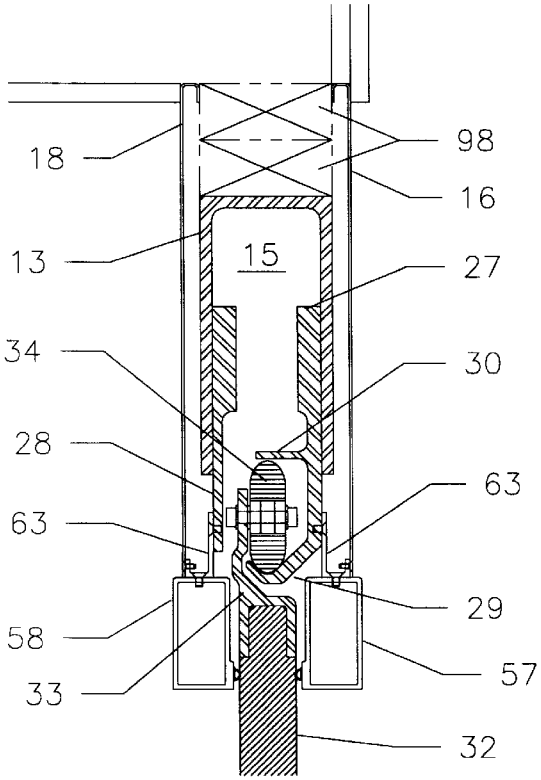
FIG. 11 is a sectional side elevation view taken along Line 11—11 in FIG. 2.

As shown in FIGS. 9, 10 and 11, the header 13 is an elongated inverted, U-shaped structure with a central space 15 created therein. Located longitudinally inside the center space 15 and attached to the opposite inside surfaces of the header 13 is an elongated track rail 27 and a support rail 28. The track rail 27 and support rail 28 both have lengths approximately equal to the length of the header 13 so that they may be supported in a horizontal position on its opposite ends by the support bases 25 located adjacent to the upper ends of the side posts 20. As shown in FIGS. 6 and 7, each support base 25 extends horizontally inward from the upper end of the support posts 20. The support base 25 includes two vertically aligned index holes 26 in which index pins 8 attached to the ends of the track rail 27 and the support rail 28 may extend to interconnect the ends of the track rail 27 and support rail 28 to the support base 25. In the embodiment shown, the support base 25 is part of the corner assembly 21 which is placed over the upper end of the side posts 20. It should be understood however, that the support bases 25 may be separately attached or affixed directly to the upper ends of the support posts 20.

After the header 13 has been positioned against the ceiling top plate and the track rail 27 and support rail 28 have been connected to the support bases 25, the track rail 27 and support rail 28 may be connected to header 13 via threaded bolts 19 that extend through vertically aligned, elongated slots 5, shown more clearly in FIG. 3, formed on the opposite sides of the header 13 and threaded holes (not shown) formed on the track rail 27 and support rail 28.

The track rail 27 is attached to the front flange surface of the header 13 and includes an integrally formed wheel track 29 that extends downward through the lower opening 17 of the header 13 when the header 13 and track rail 27 are proper positioned. Integrally formed on the track rail 27 is an inward extending stop surface 30 which prevents the wheels 34 located on the hanger bracket 33 attached to the sliding door 32 from being vertically lifted from the track rail 27 during use. The support rail 28 is attached to the rear flange surface of the header 13 and has a sufficient width so that it extends downward through the lower opening 17 of the header 13. The purpose of support rail 28 is to support the coil 66 and the sealing frame assembly members discussed further below.

Located inside the header 13 is a low profile motor assembly 65 coupled to the sliding door 32 that selectively moves the sliding door 32 over the track rail 27. The motor assembly 65 is a brush-less, linear-servo electric motor disposed inside the central space 15 of the header 13. The motor assembly 65 includes an elongated T-shaped coil 66 disposed longitudinally inside the central space 15. The coil 66 includes a top horizontal member 68 that attaches to the top flange surfaces of the track rail 27 and support rail 28 via threaded connectors 6 as shown in FIG. 5. The coil 66 also includes a plurality of downward projecting center members 67 that extend downward inside the center space 15 as shown in FIG. 10. It should be understood that the plurality of center members 67 could be replaced with an elongated, single center member.

In addition to the coil 66, the motor assembly 65 includes an upward extending, U-shaped magnet 69 that moves longitudinally over the center members 67 when an electric current is applied to the coil 66. The magnet 69 is attached to a magnet support bracket 31 that is attached at one end to a hanger bracket 33 also attached to the sliding door 32. As shown in FIG. 10, during assembly the opposite legs of the magnet 69 are designed to be closely disposed around the central members 67 of the coil 66. Small gaps are formed between the legs and the central member 67 so that no contact is made thereby eliminating wear, and reducing noise. By changing the flow of electric current in the coil 66, the direction of movement of the magnet 69 and the sliding door 32 over the coil 66 may be controlled. When no electric current is flowing through the coil 66, the sliding door 32 may be moved along the track rail 27 to manually open or close the sliding door 32.

As shown in FIG. 4, the lengths and relative positions of the coil 66 and the magnet 69 are sufficient so that the sliding door 32 may be moved between fully opened and closed positions. In the preferred embodiment, the motor assembly 65 is made by Northern Magnetics, Inc. This particular model of motor 65 is desirable because it has a relatively small profile for placement inside the header 13 and moves the sliding door 32 in and out of the pocket 40 rapidly and quietly.

Figure 8:
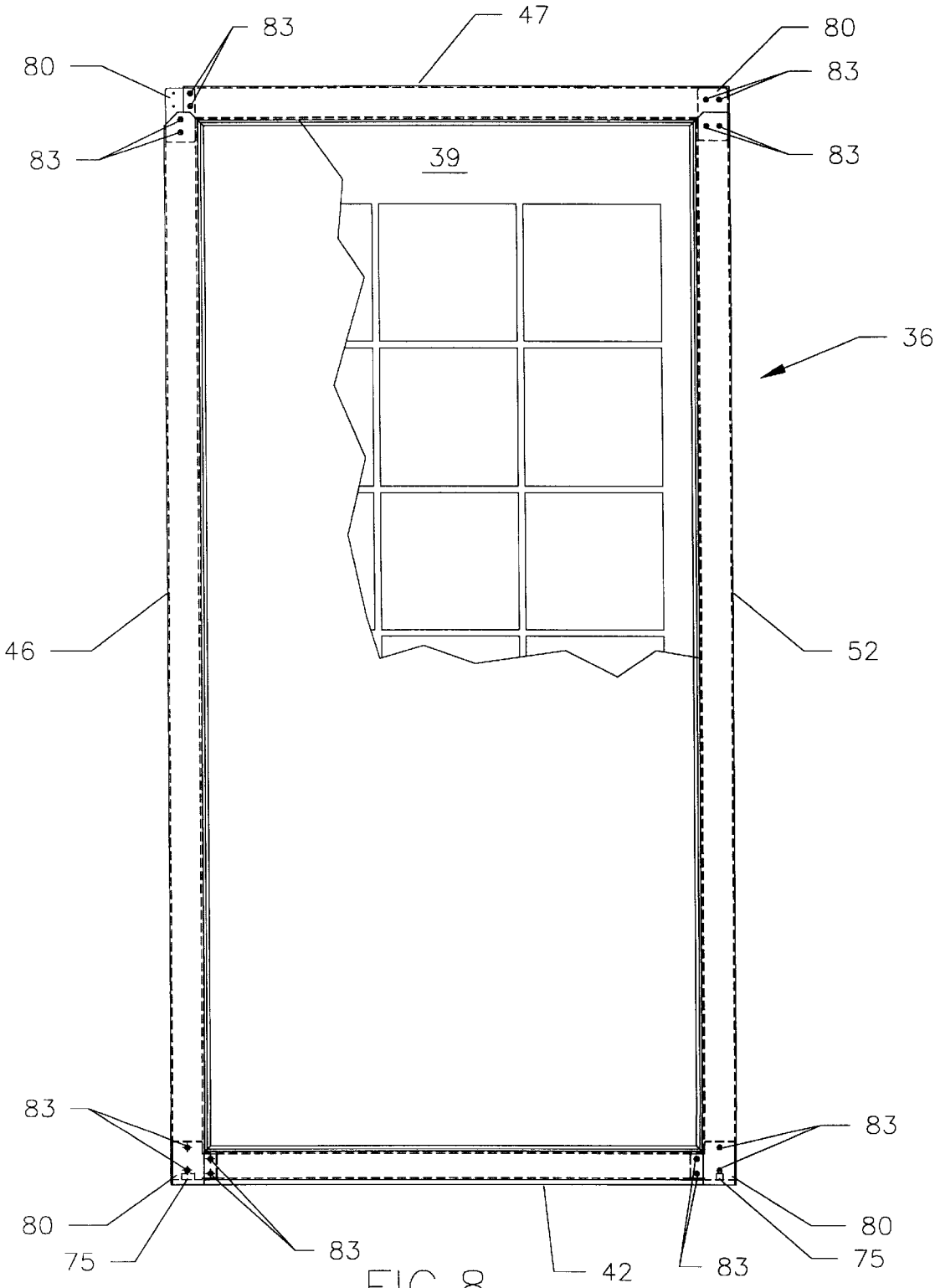
FIG. 8 is a front elevation view of a fixed panel.
Figure 13:
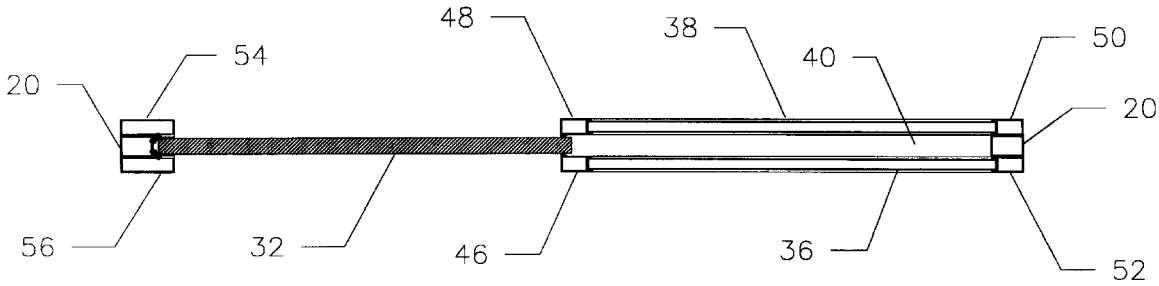
FIG. 13 is a sectional top plan view taken along Line 13—13 in FIG. 2.
Figure 14:
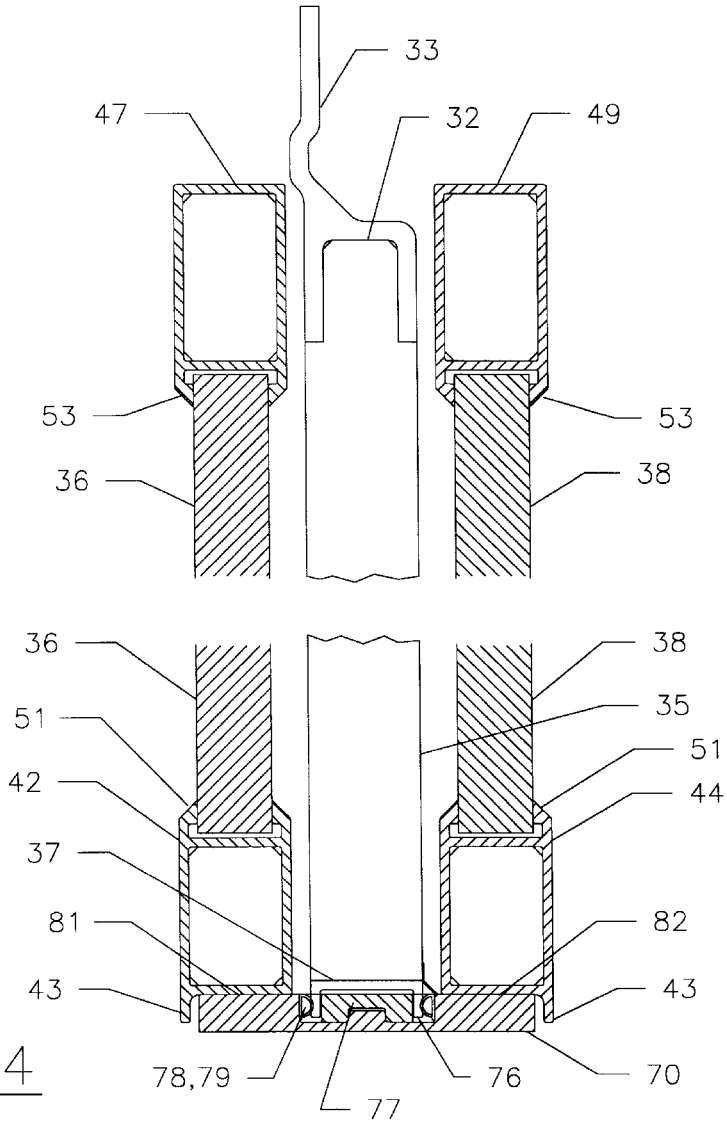
FIG. 14 is a sectional side elevational view taken along Line 14—14 in FIG. 2.

As shown in FIGS. 4, 13, and 14, disposed vertically over one side of the open space 14 located inside the support frame 12 are two fixed panels 36 and 38. The fixed panels 36, 38 are aligned parallel and spaced apart a sufficient distance to create a narrow, vertically aligned pocket 40 in which the sliding door 32 may extend when the sliding door 32 is moved to an open position. As shown in FIG. 8, each fixed panel (inside fixed panel 38 shown) is rectangular and includes two horizontal frame members 42, 47 and two vertical frame members 46, 52 that enclose a flat, central panel 39. A corner bracket 80 and threaded connectors 83 are used at each corner to connect the frame members 46, 47 and 42 and 52, together. The central panel 39 may be constructed of a plurality of window panels (as shown) or a solid planar structure. The outside fixed panel 36 is constructed in an identical manner.

As shown in the FIG. 14, the lower frame members 42, 44 on the inside and outside front panels 36, 38 are disposed over the threshold 70 during assembly. Formed on the outside edge of each lower frame member 42, 44 is an overhanging lip 43 that extends downward over the outer flange surface of the threshold 70. Each frame member 42, 44 includes a longitudinally aligned slot 51 designed to receive the lower edge of the central panels 39 used in the fixed panels 36, 38. Pins 75 that extend upward from the threshold 70 and insert into holes (not shown) formed on the brackets 80 are used to attach the lower edge of each frame members 42, 44 to the threshold 70. As shown in FIG. 14, the two upper frame members 47, 49 also include longitudinally aligned slots 53 used to receive the upper edge of the two fixed panels 36, 38 respectively.

Figure 12:
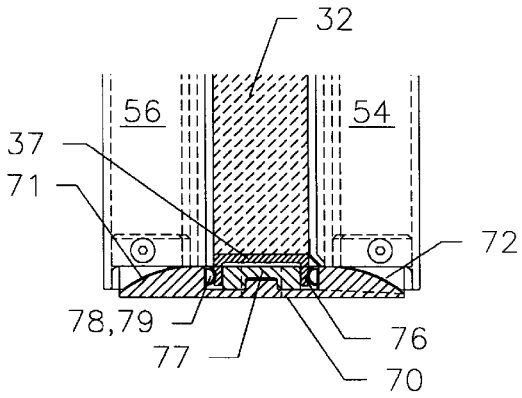
FIG. 12 is a sectional side elevation view taken along Line 12—12 in FIG. 2.

As mentioned above, the support frame 12 includes a threshold 70 that extends horizontally under the two side posts 20 and attaches to the sub-floor 100. As shown in FIG. 12, the section of threshold 70 located directly under the sliding door 32 when closed includes two opposite outside and inside sloped treads, 71, 72, respectively. Located between the two treads 71, 72 is a longitudinally aligned, central cavity 74 with a longitudinally aligned, raised guide member 77 located therein. The guide member 77 is centrally located and is slightly smaller than the cavity 74 thereby creating two longitudinal gaps 78 on opposite sides of the guide member 77. Located on the two inside sidewalls of the guide member 77 are D-shaped seals 79 which extend laterally to press against the lips 76 when the sliding door 32 is moved to a closed position thereby providing a weather-tight seal along the bottom edge of the sliding door 32. Also formed on the lower edge of the sliding door 32 are two downward extending lips 76 that extend into the gaps 78. The lips 76 and gaps 78 act to keep the sliding door 32 properly aligned over the sloped treads 71 and 72.

On the section of threshold 70 located under the two fixed panels 36, 38, the sloped treads 71, 72 are replaced with outside and inside flat support surfaces 81, 82, respectively, as shown in FIG. 14.

The sliding door assembly 10 is designed to be attractive, secure and weather-tight. In order to accomplish these objectives, a sealing frame assembly 45 is placed around the outer edges the of support frame 12, the header 13 and the upper edge of the sliding door 32. As shown in FIGS. 2 and 10, the sealing frame assembly 45 includes outside and inside covers 16 and 18, respectively, that completely cover the outside and inside surfaces of the header 13. The sealing frame assembly 45 also includes an outside elongated molding member 54, 56 respectively, disposed on opposite sides of the side member 20 against which the sliding door 32 closes, as shown in FIG. 13. Thirdly, the sealing frame assembly 45 includes two upper door frame members 57, 58 located over the front and back upper edges of the sliding door 35. The door frame members 57 and 58 are attached to brackets 63 that connect to the track rail 27 and support rail 28, respectively. Threaded screws are used to attach the brackets 63 to the rails 27, 28 and to attach the frame members 57, 58 to the brackets 63. Threaded screws are also used to connect the covers 16 and 18 to the frame members 57, 58.

A locking means is provided between the support frame 12 and the sliding door 32. In the preferred embodiment shown in FIG. 4, the locking means comprises a self-locking electric mechanical lock 90 located adjacent to the sliding door assembly 10. The lock 90 includes a pivoting latch 91 that rotates and engages a striker bar 92 located on the sliding door 32. The lock 90 is connected to a switch 93 connected to a D.C. electricity source (not shown). The switch 93 is also connected to the motor assembly 65 discussed above so that the motor assembly 65 operates with the lock 90. An optional manual unlocking means, such a pull cord 94, may be attached to the latch 91 that enables the sliding door 32 to be locked and opened during electrical power outages.

Because the invention is precision designed and made to close tolerances, the support frame 12 and components of the sealing frame assembly 45 are preferably made of aluminum or other machinable material. The sliding door 32 and the fixed panels 36, 38, may be made of metal, wood or glass in an outer metal frame. The components of the threshold 70 may be made of metal, wood or a combination thereof. Although the sliding door assembly 10 of the present invention can be used in new construction, it is especially designed for residential construction and retrofits, as the sliding door assembly 10 includes a load-bearing header 13. In a remodel installation, the complete sliding door assembly 10 may be incorporated into existing walls without the creation of an additional structural header, which may require more space than is available. In the preferred embodiment, the support frame 12 is designed to fit into an opening 97 which measures at least 94 inches in height and 84 ½ inches in width.

In compliance with the statute, the invention described herein has been described in language more or less specific as to structural features. It should be understood, however, that the invention is not limited to the specific features shown, since the means and construction shown, comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A sliding door assembly, comprising:

a. a support frame, said support frame having two vertical posts and a load-bearing header supported at its opposite ends, said support frame having an open space created between said vertical posts and said header, said header having a central space;

b. means for adjusting the opposite ends of said header enabling the position of said opposite ends of said header to be selectively adjusted with respect to an adjacent said vertical post;

c. two fixed panels disposed vertically in said open space formed in said support frame, said fixed panels being disposed in a parallel, spaced apart position to create a vertically aligned pocket;

d. a track rail disposed longitudinally inside said central space in said header;

e. a sliding door vertically aligned inside said open space;

f. a sliding door attachment means capable of attaching said sliding door to said track rail, said sliding door attachment means enabling said sliding door to be disposed vertically inside said open space and moved longitudinally over said track rail, and;

g. a motor disposed inside said header and coupled to said sliding door and capable of moving said sliding door along said track rail.

2. A sliding door assembly as recited in claim 1, further including said support frame having a threshold located parallel and opposite to said header.

3. A sliding door assembly, as recited in claim 2, further including a guide means located between said sliding door and said threshold capable of aligning said sliding door over said threshold.

4. A sliding door assembly, as recited in claim 1, wherein said means for adjusting the opposite ends of said header is a pair of corner assemblies each including an adjustable jack screw disposed between the ends of said vertical posts and said header enabling said header to be selectively adjusted in position over said vertical posts.

5. A sliding door assembly, as recited in claim 1 further including a pair of support posts located on said vertical posts capable of supporting the track rail in a substantially horizontal position between said vertical posts.

6. A sliding door assembly, as recited in claim 1, wherein said motor is a linear motor.

7. A sliding door assembly, as recited in claim 6, wherein said linear motor includes a fixed coil and a moveable magnet.

8. A sliding door assembly, as recited in claim 7, wherein said fixed coil is attached to said header and said magnet is attached to said sliding door.

9. A sliding door assembly, as recited in claim 1, further including a sealing frame assembly located around said vertical posts and said sliding door to create a weather-tight seal therearound.

10. A sliding door assembly, comprising:

a. a support frame having two vertical posts, a header, and a threshold, said header having a central space;

b. a drive unit including a track rail and a motor disposed inside said central space in said header;

c. a vertically aligned sliding door with a hanger bracket attached thereto for connection to said track rail;

d. guide rail located on said sliding door for aligning said sliding door over said threshold; and, e. two vertically aligned fixed panels, said fixed panels being spaced apart to create a vertically aligned pocket for said sliding door, said fixed panels being substantially the same width as said sliding door.

11. A sliding door assembly, as recited in claim 10, further including a corner assembly disposed between each said vertical post and said header, each said corner assembly including an adjustable jack screw disposed between said vertical post and said header enabling said header to be selectively adjusted in position thereover.

12. A sliding door assembly, as recited in claim 11, further including a pair of support posts located on said vertical posts capable of supporting the track rail in a substantially horizontal position between said vertical posts.

13. A sliding door assembly, as recited in claim 12, wherein said motor is a linear motor.

14. A sliding door assembly, as recited in claim 13, wherein said linear motor includes a fixed coil and a moveable magnet.

15. A sliding door assembly, as recited in claim 14, wherein said fixed coil is attached to said header and said magnet is attached to said sliding door.

16. A sliding door assembly, comprising:

a. a sliding door;

b. a pocket located adjacent to and capable of longitudinally receiving said sliding door;

c. a support frame surrounding said sliding door and said pocket, said support frame including an adjustable header supported by two vertical posts and a threshold;

d. a means for adjusting the position of said header between each said vertical post;

e. a track rail disposed inside said header;

f. an electric motor attached to said sliding door capable of selectively moving said sliding door along said track rail; and, g. a sealing frame assembly located around said support frame and said sliding door to create a weather-tight seal therebetween when said sliding door is in a closed position.

17. A sliding door assembly, as recited in claim 16, wherein said motor is a linear motor.

18. A sliding door assembly, as recited in claim 16, wherein said header means for adjusting the position of said header is a pair of adjustable jack screws disposed between said vertical posts and said header enabling said header to be selectively adjusted in position over said vertical posts.

19. A sliding door assembly, as recited in claim 18, further including a pair of support posts located on said vertical posts capable of supporting the track rail in a substantially horizontal position between said vertical posts.

20. A sliding door assembly, as recited in claim 16, further including a switch means coupled to said motor enabling said motor to be selectively turned on or off.

* * * * *